US011621473B2

(12) United States Patent
Tsai

(10) Patent No.: US 11,621,473 B2
(45) Date of Patent: Apr. 4, 2023

(54) ANTENNA STRUCTURE AND ELECTRONIC DEVICE USING SAME

(71) Applicant: Chiun Mai Communication Systems, Inc., New Taipei (TW)

(72) Inventor: Pang-Chun Tsai, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 71 days.

(21) Appl. No.: 17/332,334

(22) Filed: May 27, 2021

(65) Prior Publication Data

US 2021/0399406 A1 Dec. 23, 2021

(30) Foreign Application Priority Data

Jun. 17, 2020 (CN) ..... 202010552493.5

(51) Int. Cl.

| | |
|---|---|
| ***H01Q 1/28*** | (2006.01) |
| ***H01Q 1/22*** | (2006.01) |
| ***H01Q 21/28*** | (2006.01) |
| *H01Q 1/38* | (2006.01) |
| *H01Q 1/24* | (2006.01) |

(52) U.S. Cl.

CPC ..... *H01Q 1/2266* (2013.01); *H01Q 21/28* (2013.01); *H01Q 1/2283* (2013.01); *H01Q 1/243* (2013.01); *H01Q 1/38* (2013.01)

(58) Field of Classification Search

CPC ..... H01Q 1/38; H01Q 1/243; H01Q 21/28; H01Q 1/2266

See application file for complete search history.

(56) References Cited

U.S. PATENT DOCUMENTS

2021/0075090 A1* 3/2021 Yarga ..... H01Q 1/241

FOREIGN PATENT DOCUMENTS

| | | |
|---|---|---|
| CN | 208522084 U | 2/2019 |
| TW | 201929320 A | 7/2019 |

* cited by examiner

*Primary Examiner* — Graham P Smith
(74) *Attorney, Agent, or Firm* — ScienBiziP, P.C.

(57) ABSTRACT

An antenna structure of reduced size but able to operate at multiple frequencies, and applied to an electronic device, includes a housing, a first feed point, a first radiation portion, a first ground point, a second radiation portion, and a second feed point. The housing has at least one portion made of metal material with first and second gaps therein. The housing between first and second gaps forms the first radiation portion. The first feed point feeds current and signal to the first radiation portion. The first ground point is spaced from the first feed point and is grounded through a first inductive element. The second radiation portion is adjacent to the first radiation portion. The second feed point is electrically connected to a second signal point and feeds current and signal to the second radiation portion.

18 Claims, 15 Drawing Sheets

ANTENNA STRUCTURE AND ELECTRONIC DEVICE USING SAME

FIELD

The subject matter herein generally relates to wireless communications, to an antenna structure, and an electronic device using the antenna structure.

BACKGROUND

Antennas are for receiving and transmitting wireless signals at different frequencies. However, current antenna structures are complicated and occupy a large space in an electronic device, which makes the miniaturization of the electronic device problematic.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
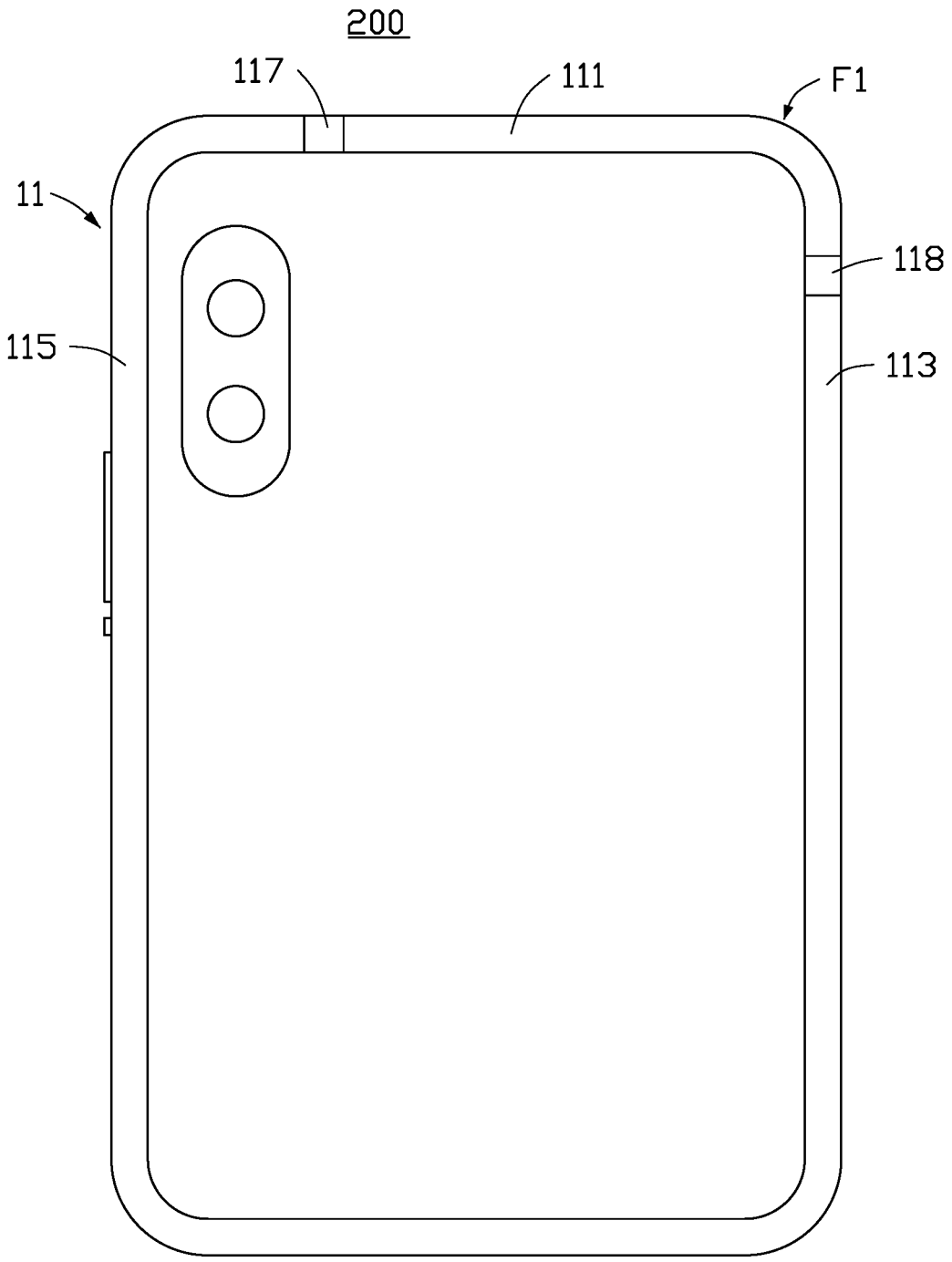
FIG. 1 is a schematic diagram of a first embodiment of an antenna structure, applied in an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better show details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and an electronic device using the same.

Figure 2:
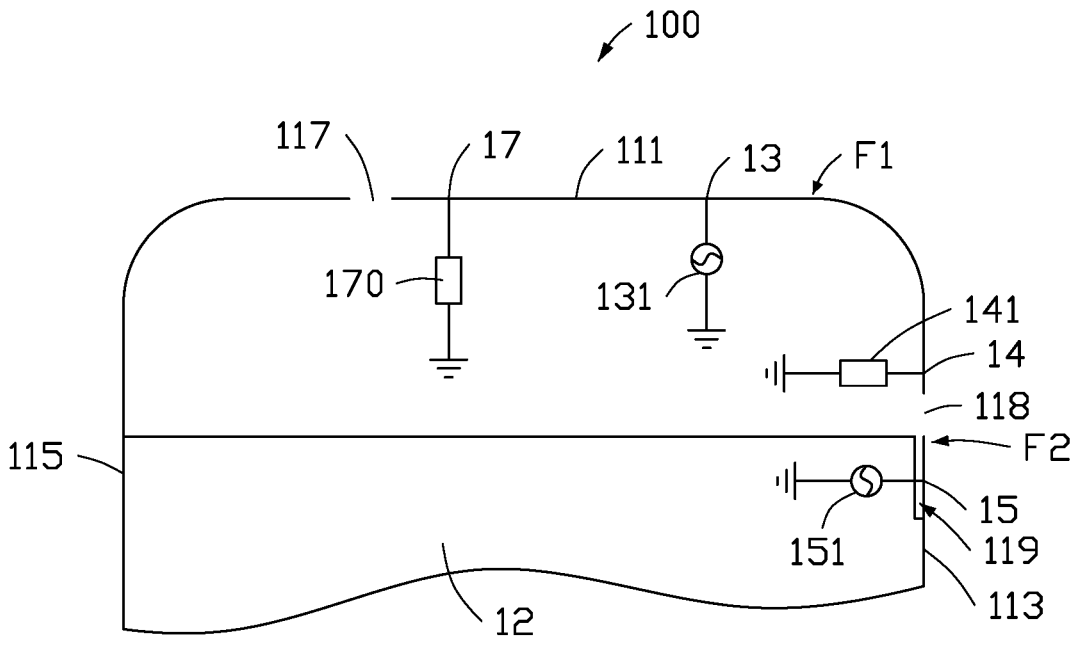
FIG. 2 is a circuit diagram of the antenna structure of FIG. 1.

FIG. 1 and FIG. 2 illustrate a first embodiment of an electronic device 200 using an antenna structure 100. The electronic device 200 can be, for example, a mobile phone or a personal digital assistant. The antenna structure 100 can transmit and receive radio waves.

In this embodiment, the electronic device 200 may use one or more of the following communication technologies: BLUETOOTH communication technology, global positioning system (GPS) communication technology, WI-FI communication Technology, global system for mobile communications (GSM) communication technology, wideband code division multiple access (WCDMA) communication technology, long term evolution (LTE) communication technology, 5G communication technology, SUB-6G communication technology, and other future communication technologies.

In other embodiments, the electronic device 200 may also include one or more components, such as a processor, a circuit board, a display, a memory, a power supply component, an input/output circuit, audio components (such as a microphone and a speaker, etc.), imaging components (for example, a front camera and/or a rear camera), and several sensors (such as a proximity sensor, a distance sensor, an ambient light sensor, an acceleration sensor, a gyroscope, a magnetic sensor, a pressure sensor, and/or a temperature sensor, etc.).

The antenna structure 100 at least includes a housing 11, a system ground plane 12, a first feed point 13, a first ground point 14, a second feed point 15, and a switching point 17.

The housing 11 can be a housing of the electronic device 200. The housing 11 is made of metal or other conductive materials. The system ground plane 12 is made of metal or other conductive materials. The system ground plane 12 is positioned inside the housing 11 and is configured for grounding the antenna structure 100.

In one embodiment, the housing 11 includes at least a first portion 111, a second portion 113, and a third portion 115. The first portion 111 is a top end of the electronic device 200. That is, the first portion 111 is a top metallic frame of the electronic device 200. The antenna structure 100 constitutes an upper antenna of the electronic device 200. The second portion 113 and the third portion 115 are positioned opposite to each other, they may be equal in length and longer than the first portion 111. The second portion 113 and the third portion 115 are metallic side frames of the electronic device 200.

The housing 11 defines at least one gap. In this embodiment, the housing 11 defines two gaps, namely, a first gap 117 and a second gap 118. In detail, the first gap 117 is defined in the first portion 111 adjacent to the third portion 115. The second gap 118 is defined in the second portion 113.

In this embodiment, the first gap 117 and the second gap 118 both penetrate and interrupt the housing 11. The at least one gap divides the housing 11 into at least two radiation portions. In this embodiment, the first gap 117 and the second gap 118 divide the housing 11 into two radiation portions, that is, a first radiation portion F1 and a second radiation portion F2. In this embodiment, the housing 11 between the first gap 117 and the second gap 118 forms the first radiation portion F1. That is, the first radiation portion F1 is positioned at a corner of the electronic device 200, for example, a left top corner of the electronic device 200, namely, the first radiation portion F1 is formed by a portion of the first portion 111 and a portion of the second portion 113.

In this embodiment, the housing 11*a* between the second gap 118 and the second portion 113 away from the second gap 118 and the first radiation portion F1 (that is, a portion of the second portion 113) forms the second radiation portion F2. In this embodiment, the second radiation portion F2 is adjacent to the first radiation portion F1. The first radiation portion F1 and the second radiation portion F2 are positioned at two sides of the second gap 118. A length of the first radiation portion F1 for electrical purposes is longer than that of the second radiation portion F2.

In this embodiment, the housing 11 at least includes a side frame (not shown). The side frame can be a metallic side frame of the electronic device 200. The first radiation portion F1 and the second radiation portion F2 are positioned on the side frame.

In this embodiment, when a width of either the first gap 117 or the second gap 118 is less than 2 millimeters (mm), a radiation efficiency of the antenna structure 100 is affected. Therefore, the widths of the first gap 117 and the second gap 118 are generally not less than 2 mm. Additionally, the greater the width of the first gap 117 and the width of the second gap 118, the better the efficiency of the antenna structure 100. Considering an overall aesthetic appearance of the electronic device 200 in addition to the radiation efficiency of the antenna structure 100, the widths of both the first gap 117 and the second gap 118 can be set to 2 mm.

In this embodiment, the first gap 117 and the second gap 118 are both filled with an insulating material (such as plastic, rubber, glass, wood, ceramic, etc., not being limited to these).

In this embodiment, one end of the system ground plane 12 adjacent to the first portion 111 and the second gap 118 defines a slit 119, along a direction parallel to the second portion 113 and close to the first portion 111. The slit 119 is in the shape of a straight strip communicating with the second gap 118. The slit 119 is positioned corresponding to the second radiation portion F2. For example, two ends of the slit 119 correspond to two ends of the second radiation portion F2. A length of the slit 119 is equivalent to a length of the second radiation portion F2 for electrical purposes.

In this embodiment, the first feed point 13 is positioned on the first radiation portion F1 and on the first portion 111. The first feed point 13 may be electrically connected to a first signal point 131 by means of an elastic sheet, a microstrip line, a strip line, or a coaxial cable, to feed current and signals to the first radiation portion F1. In this embodiment, a length from the first feed point 13 to the first gap 117 is longer than a length from the first feed point 13 to the second gap 118.

In this embodiment, the first ground point 14 is positioned on the first radiation portion F1 and on the second portion 113. The first ground point 14 is positioned adjacent to the second gap 118 and is grounded through a first inductive element 141.

In this embodiment, the second feed point 15 is positioned on the second radiation portion F2. The second feed point 15 may be electrically connected to a second signal point 151 by means of an elastic sheet, a microstrip line, a strip line, or a coaxial cable, to feed current and signals to the second radiation portion F2.

In this embodiment, the switching point 17 is positioned on the first radiation portion F1 and on the first portion 111 adjacent to the first gap 117. The switching point 17 is grounded through a switch circuit 170.

Figure 3:
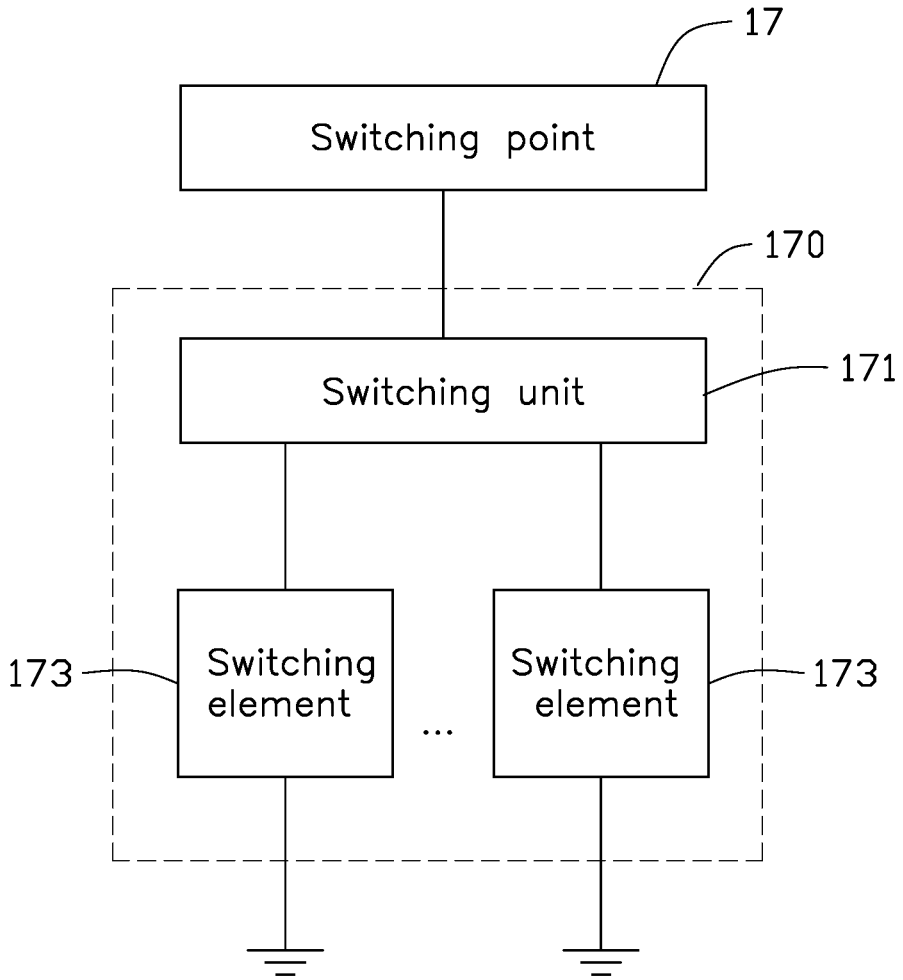
FIG. 3 is a circuit diagram of a switch circuit of the antenna structure of FIG. 2.

As illustrated in FIG. 3, the switch circuit 170 includes a switching unit 171 and a plurality of switching elements 173. The switching unit 171 may be a single pole single throw switch, a single pole double throw switch, a single pole three throw switch, a single pole four throw switch, a single pole six throw switch, a single pole eight throw switch, or the like. The switching unit 171 is electrically connected to the switching point 17, thereby achieving connection with the first radiation portion F1. The switching elements 173 can be inductors, capacitors, or a combination of them. The switching elements 173 are connected in parallel to each other. One end of each switching element 173 is electrically connected to the switching unit 171. The other end of each first switching element 173 is grounded. The switching unit 171 can switch between different switching elements 173 to achieve connection with the first radiation portion F1, thereby radiation frequencies of the first radiation portion F1 can be adjusted (see detail below).

Figure 4:
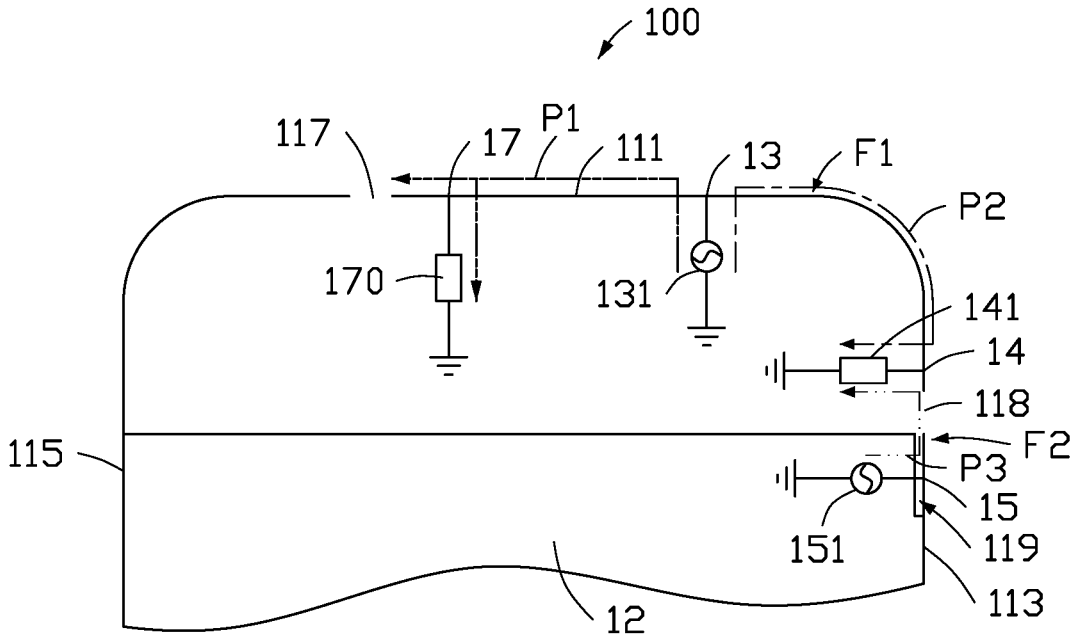
FIG. 4 is a current path distribution graph of a first radiation portion of the antenna structure of FIG. 2.

FIG. 4 illustrates a current path of the first radiation portion F1 of the antenna structure 100. When the first feed point 13 supplies a current, the current flows through a portion of the first radiation portion F1 between the first feed point 13 and the first gap 117 (hereinafter referred to as a first radiation section), towards the first gap 117, and is grounded through the switching point 17 and the switch circuit 170 (path P1).

When the first feed point 13 supplies a current, the current also flows through a portion of the first radiation portion F1 between the first feed point 13 and the second gap 118 (hereinafter referred to as a second radiation section), and is grounded through the first inductive element 141 (path P2).

In this embodiment, the first radiation section of the first radiation portion F1 is a low frequency/ultra-middle frequency/middle frequency radiator, which excites a Long Term Evolution Advanced (LTE-A) low frequency, ultra-middle frequency, and middle frequency modes. The second radiation section of the first radiation portion F1 is grounded through the first inductive element 141, to form a 5GNR N79 radiator, which excites an LTE-A high frequency and a 5GNR N79 mode.

The first inductive element 141 at the first ground point 14 can also generate coupling resonance with the second feed point 15. That is, when the current is fed from the second feed point 15, the current will be coupled to the first inductive element 141 through the second gap 118 and be grounded (path P3). Thus, the first radiation portion F1 will couple and resonate in ultra-high frequency and 5G NR N77 and N78 modes, so that working frequency range of the first radiation portion F1 covers 1710-5000 MHz.

In this embodiment, the first feed point 13, the first ground point 14, and the first inductive element 141 are set at appropriate locations of the first radiation portion F1. In this way, LTE-A low, middle, and high frequency modes, ultra-middle frequency mode, ultra-high frequency mode, and 5G NR mode (including N77/N78/N79 modes) can be achieved by resonance using this antenna architecture.

In this embodiment, the switch circuit 170 is set on the first radiation section of the first radiation portion F1, then frequency offset of LTE-A low frequency band and LTE-A middle frequency band can be controlled or adjusted by using inductors, capacitors, or a combination of these inductors and capacitors. The first radiation portion F1 thereby covers the ultra-middle frequency band (1448-1511 MHz), and the low frequency band covers 600-960 MHz, namely 703-804 MHz, 791-862 MHz, 824-894 MHz, and 880-960 MHz (i.e. B28/B20/B5/B8 bands).

Figure 5:
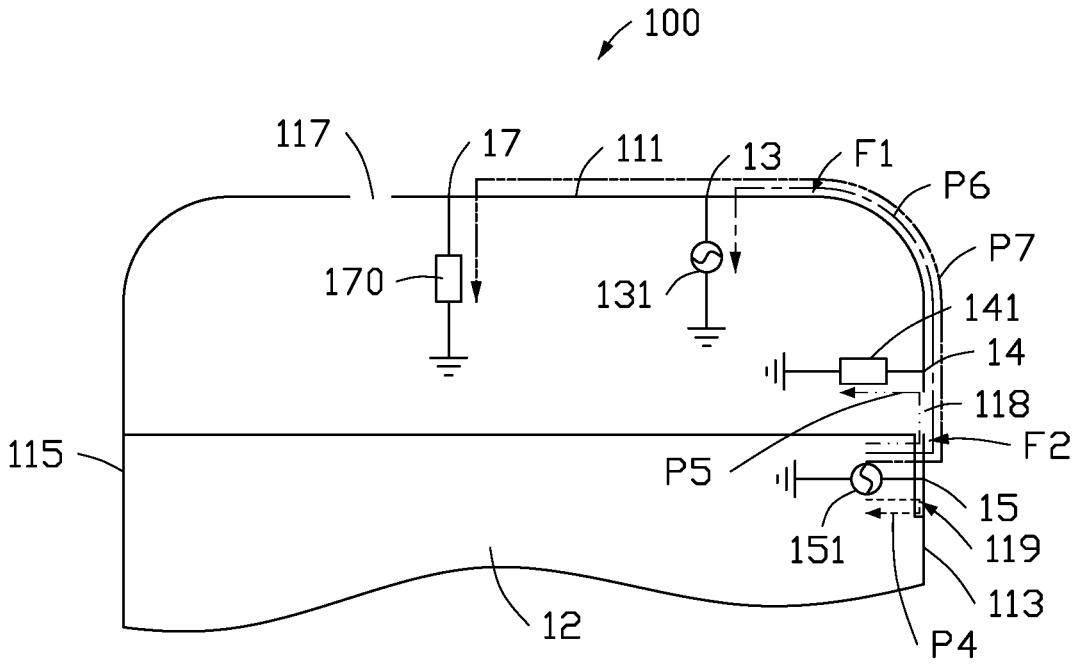
FIG. 5 is a current path distribution graph of a second radiation portion of the antenna structure of FIG. 2.

FIG. 5 illustrates a current path of the second radiation portion F2 of the antenna structure 100. When the second feed point 15 supplies a current, the current flows through a portion of the second radiation portion F2 between the second feed point 15 and an end of the second radiation portion F2 away from the second gap 118 (hereinafter referred to as a third radiation section, using path P4). When the second feed point 15 supplies a current, the current flows through a portion of the second radiation portion F2 between the second feed point 15 and the second gap 118 (hereinafter referred to as a fourth radiation section), and is coupled to the first inductive element 141 of the first radiation portion F1 through the second gap 118 (this is path P5).

When the second feed point 15 supplies a current, the current flows through the fourth radiation section, then is coupled to the second radiation section of the first radiation portion F1 through the second gap 118, and flows through the first feed point 13 and the first signal point 131 (path P6). When the second feed point 15 supplies a current, the current flows through the fourth radiation section of the second radiation portion F2, is coupled to the second radiation section and the first radiation section of the first radiation portion F1 through the second gap 118, and flows through the switching point 17 and the switch circuit 170 (path P7).

In this embodiment, the third radiation section of the second radiation portion F2 is a 5GNR N79 radiator, which excites a 5GNR N79 mode. The fourth radiation section of the second radiation portion F2 is coupled with the first inductive element 141, to resonate and excite ultra-middle frequency and 5GNR N77, N78 modes. The first inductive element 141 is used to adjust or control the frequency offset of the ultra-high frequency mode, and 5G NR N77 and N78 modes. In addition, the fourth radiation section of the second radiation portion F2 is coupled with the second radiation section of the first radiation portion F1 to resonate in the high frequency mode. The fourth radiation section of the second radiation portion F2 is also coupled with the first radiation section and the second radiation section of the first radiation portion F1 to resonate in the middle frequency mode.

Figure 6:
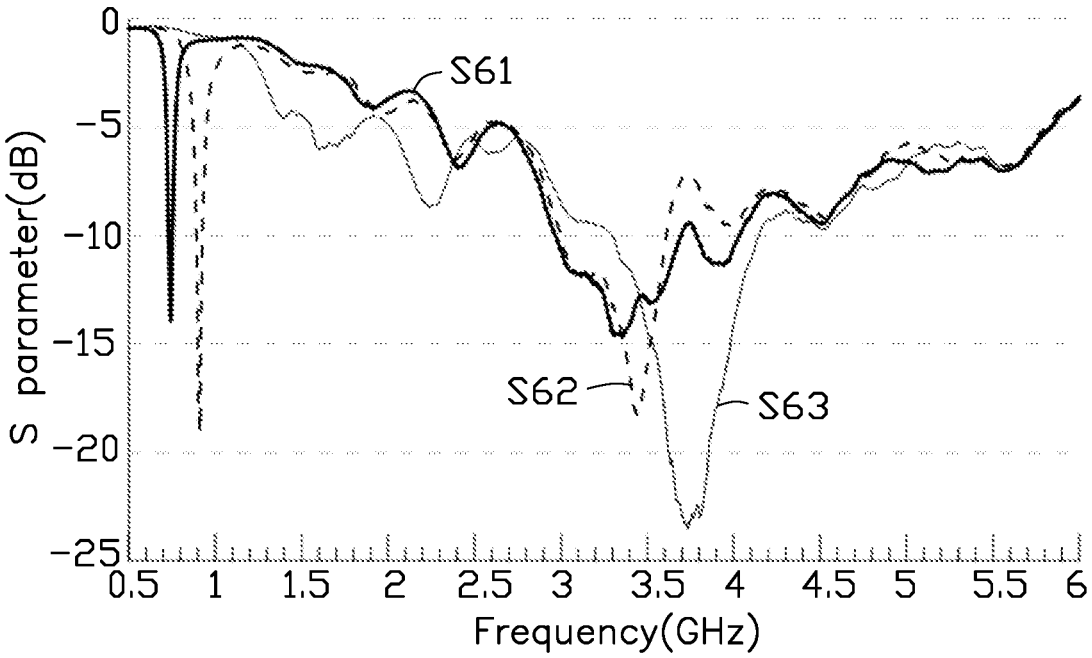
FIG. 6 is a scattering parameter graph of the first radiation portion of the antenna structure of FIG. 2.

FIG. 6 is a scattering parameter graph of the first radiation portion F1 of the antenna structure 100. A curve S61 is an S11 value of the antenna structure 100, when the first radiation portion F1 works in a frequency band of LB 700, a middle frequency band, a high frequency band, an ultra-high frequency band (UHB), and 5G sub6 NR N77/N78/N79 frequency bands. A curve S62 is an S11 value of the antenna structure 100, when the first radiation portion F1 works in a frequency band of LB 900, a middle frequency band, a high frequency band, an ultra-high frequency band (UHB), and 5G sub6 NR N77/N78/N79 frequency bands. A curve S63 is an S11 value of the antenna structure 100, when the first radiation portion F1 works in a middle frequency band, an ultra-middle frequency band (UMB), a high frequency band, an ultra-high frequency band (UHB), and 5G sub6 NR N77/N78/N79 frequency bands.

Figure 7:
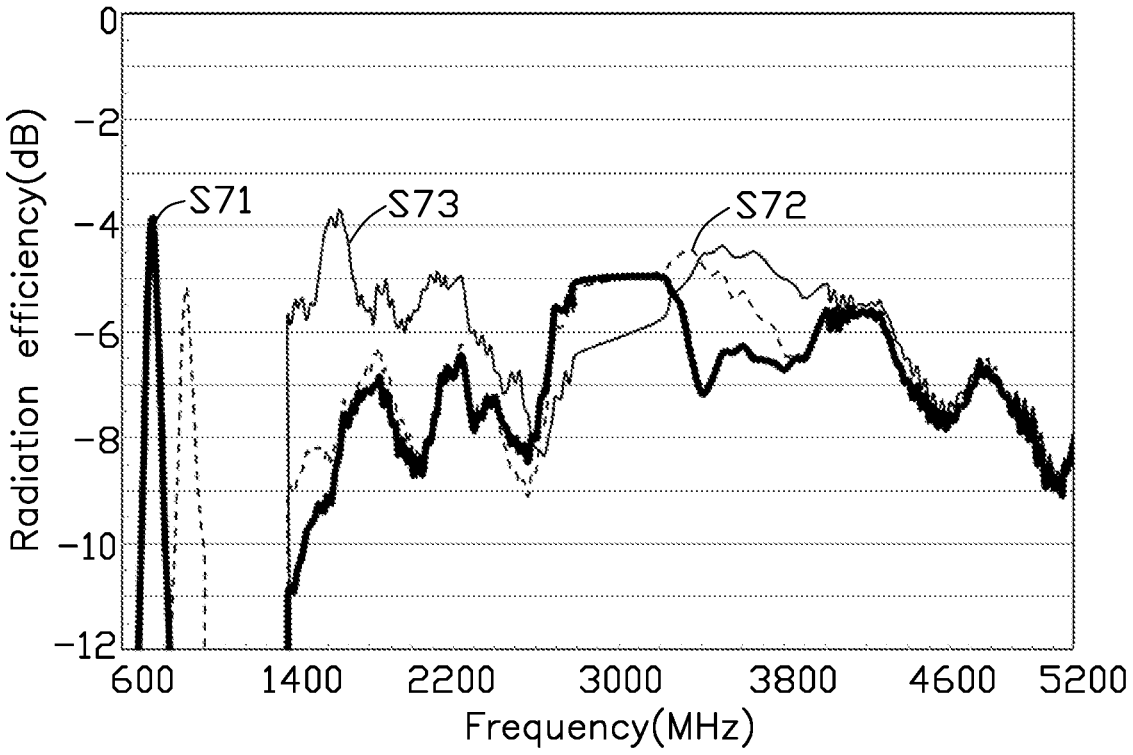
FIG. 7 is a radiation efficiency graph of the first radiation portion of the antenna structure of FIG. 2.

FIG. 7 is a radiation efficiency graph of the first radiation portion F1 of the antenna structure 100. A curve S71 is a radiation efficiency of the antenna structure 100, when the first radiation portion F1 works in a frequency band of LB 700, a middle frequency band, a high frequency band, an ultra-high frequency band (UHB), and 5G sub6 NR N77/N78/N79 frequency bands. A curve S72 is a radiation efficiency of the antenna structure 100, when the first radiation portion F1 works in a frequency band of LB 900, a middle frequency band, a high frequency band, an ultra-high frequency band (UHB), and 5G sub6 NR N77/N78/N79 frequency bands. A curve S73 is a radiation efficiency of the antenna structure 100, when the first radiation portion F1 works in a middle frequency band, an ultra-middle frequency band (UMB), a high frequency band, an ultra-high frequency band (UHB), and 5G sub6 NR N77/N78/N79 frequency bands.

As shown in FIG. 6 and FIG. 7, the middle frequency (1710-2170 MHz) of the first radiation portion F1 is the mode excited by the low frequency doubling of the first radiation section of the first radiation portion F1, and the high frequency (2300-2690 MHz) is the mode excited by the second radiation section of the first radiation portion F1. The ultra-high frequency and 5G sub6 NR N77/N78 (3300-4200 MHz) are multiple modes excited by the low frequency doubling of the first radiation section of the first radiation portion F1 and a coupling energy of the second feed point 15 of the second radiation portion F2. The 5G sub6 NR N79 (4400-5000 MHz) frequencies of the first radiation portion F1 are excited by the frequency doubling of the high frequency of the second radiation section.

Furthermore, by setting and resetting the switch circuit 170, the switch circuit 170 applies different inductances and capacitances, the first radiation portion F1 of the antenna structure 100 can be effectively controlled to cover the low frequency mode and the ultra-middle frequency mode, the low frequency mode can cover the B28/B20/B5/B8 frequency bands. The antenna structure 100 operates in additional modes through resonance of the coupling energy of the second radiation portion F2, so as to increase bandwidths of UHB and 5G sub6 NR N77/N78.

In this embodiment, the switch circuit 170 of the antenna structure 100 can include three switching elements to switch three kinds of frequency bands, namely, a frequency band of LB700 (i.e., B28, 703-803 MHz), a frequency band of LB900 (i.e., B8, 880-960 MHz), and the UMB (1448-1511 MHz). The middle frequency, high frequency, ultra-high frequency and 5G sub6 NR N77/N78/N79 of the antenna structure 100 are met with good antenna efficiency, to cover 4G communication frequency band and a 5G sub 6 communication frequency band, that is, a frequency band of 1710-5000 MHz is covered.

Figure 8:
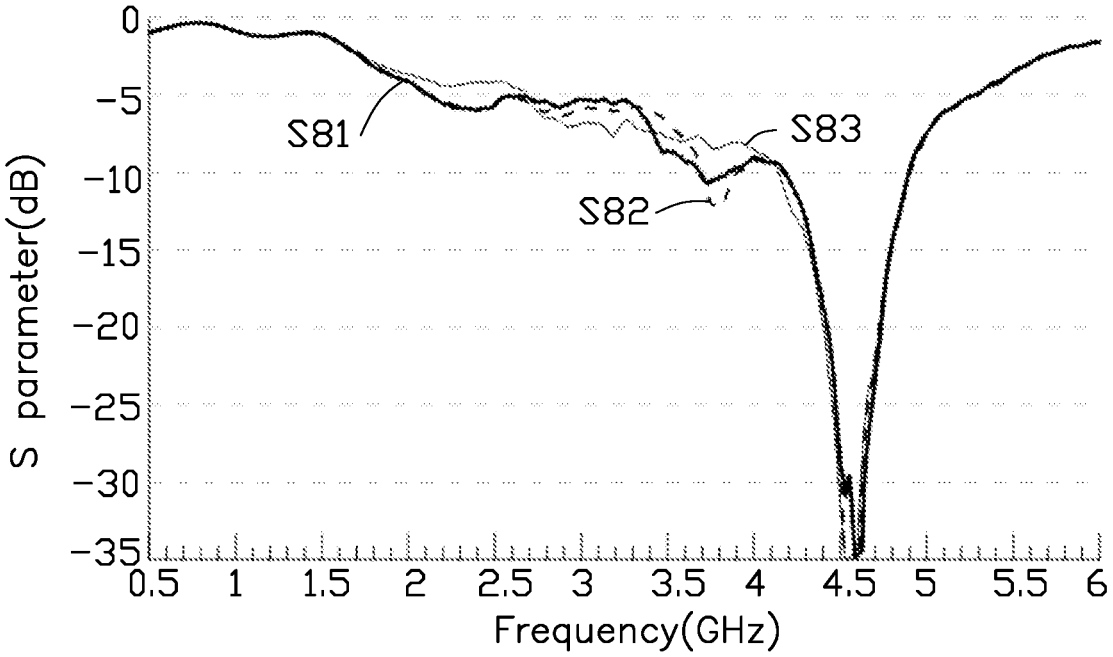
FIG. 8 is a scattering parameter graph of the second radiation portion of the antenna structure of FIG. 2.

FIG. 8 is a scattering parameter graph of the second radiation portion F2 of the antenna structure 100. A curve S81 is an S11 value of the antenna structure 100, when the first radiation portion F1 works in a frequency band of LB 700 and the second radiation portion F2 works in a middle frequency band, a high frequency band, an ultra-high frequency band (UHB), and 5G sub6 NR N77/N78/N79 frequency bands. A curve S82 is an S11 value of the antenna structure 100, when the first radiation portion F1 works in a frequency band of LB 900 and the second radiation portion F2 works in a middle frequency band, a high frequency band, an ultra-high frequency band (UHB), and 5G sub6 NR N77/N78/N79 frequency bands. A curve S83 is an S11 value of the antenna structure 100, when the first radiation portion F1 works in an ultra-middle frequency band and the second radiation portion F2 works in a middle frequency band, a high frequency band, an ultra-high frequency band (UHB), and 5G sub6 NR N77/N78/N79 frequency bands.

Figure 9:
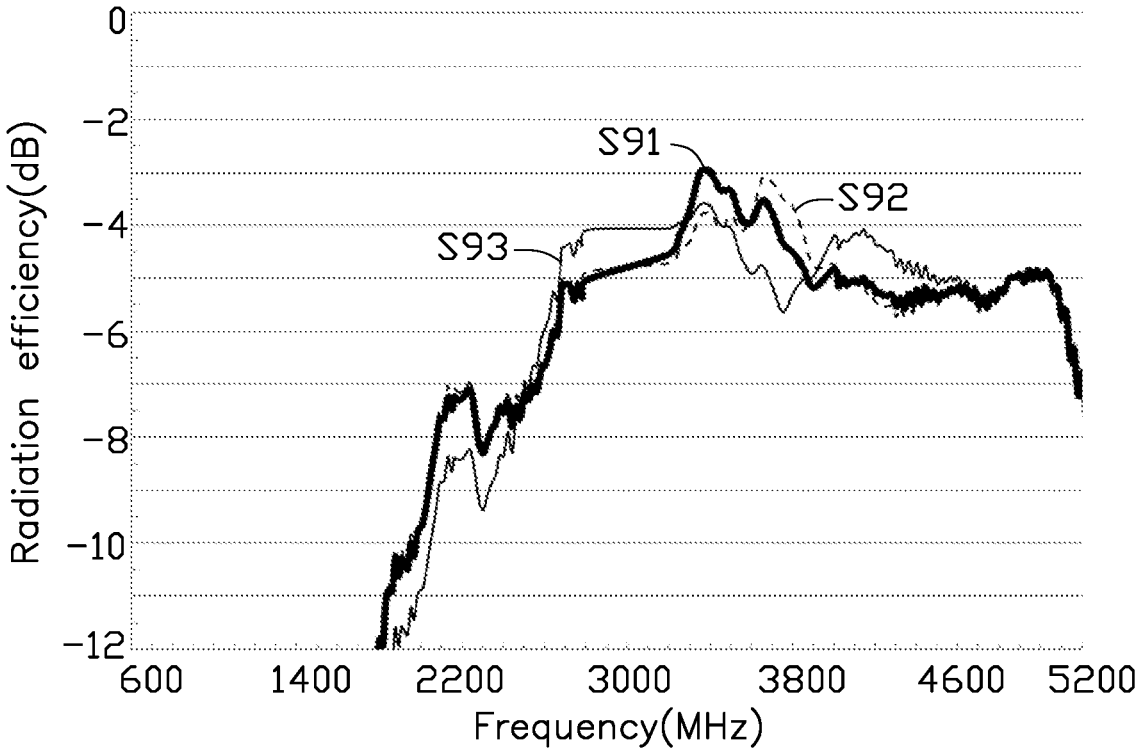
FIG. 9 is a radiation efficiency graph of the second radiation portion of the antenna structure of FIG. 2.

FIG. 9 is a radiation efficiency graph of the second radiation portion F2 of the antenna structure 100. A curve S91 is a radiation efficiency of the antenna structure 100, when the first radiation portion F1 works in a frequency band of LB 700 and the second radiation portion F2 works in a middle frequency band, a high frequency band, an ultra-high frequency band (UHB), and 5G sub6 NR N77/N78/N79 frequency bands. A curve S92 is a radiation efficiency of the antenna structure 100, when the first radiation portion F1 works in a frequency band of LB 900 and the second radiation portion F2 works in a middle frequency band, a high frequency band, an ultra-high frequency band (UHB), and 5G sub6 NR N77/N78/N79 frequency bands. A curve S93 is a radiation efficiency of the antenna structure 100, when the first radiation portion F1 works in an ultra-middle frequency band and the second radiation portion F2 works in a middle frequency band, a high frequency band, an ultra-high frequency band (UHB), and 5G sub6 NR N77/N78/N79 frequency bands.

As shown in FIG. 8 and FIG. 9, the second radiation portion F2 resonates to enable additional modes through the coupling energy with the first radiation portion F1, so as to increase the bandwidths of middle frequency and high frequency. When the switch circuit 170 of the first radiation portion F1 switches to LB700 frequency band, LB900 frequency band, and ultra-middle frequency band, good antenna efficiency is maintained for the middle frequency, high frequency, ultra-high frequency and 5G sub 6 NR N77/N78/N79, and other frequency bands of the second radiation portion F2. The general global 4G communication frequency band and 5G sub 6 communication frequency band are enabled, that is, the frequency band of 1805-5000 MHz is covered.

In this embodiment, the antenna structure 100 includes the first radiation portion F1 and the second radiation portion F2. Two radiation portions, that is, the first radiation portion F1 and the second radiation portion F2 can generate tunable broadband modes by coupling, which effectively increases the bandwidths of middle frequency, high frequency, and ultra-high frequency, with good antenna efficiency. The antenna structure 100 can cover the common frequency applications globally, and can support 5G sub 6 N77/N78/N79 frequency bands. That is, the operating frequency range of the antenna structure 100 covers low frequency (703-960 MHz), ultra-middle frequency (1448-1511 MHz), middle frequency (1710-2170 MHz), high frequency (2300-2690 MHz), ultra-high frequency (3400-3800 MHz), and 5G sub6 NR N77/N78/N79 (3300-5000 MHz). Furthermore, an antenna tuner at the antenna feed end, such as at the first feed point 13 and/or at the second feed point 15 is not needed by the antenna structure 100, reducing a production cost of the product.

Figure 10:
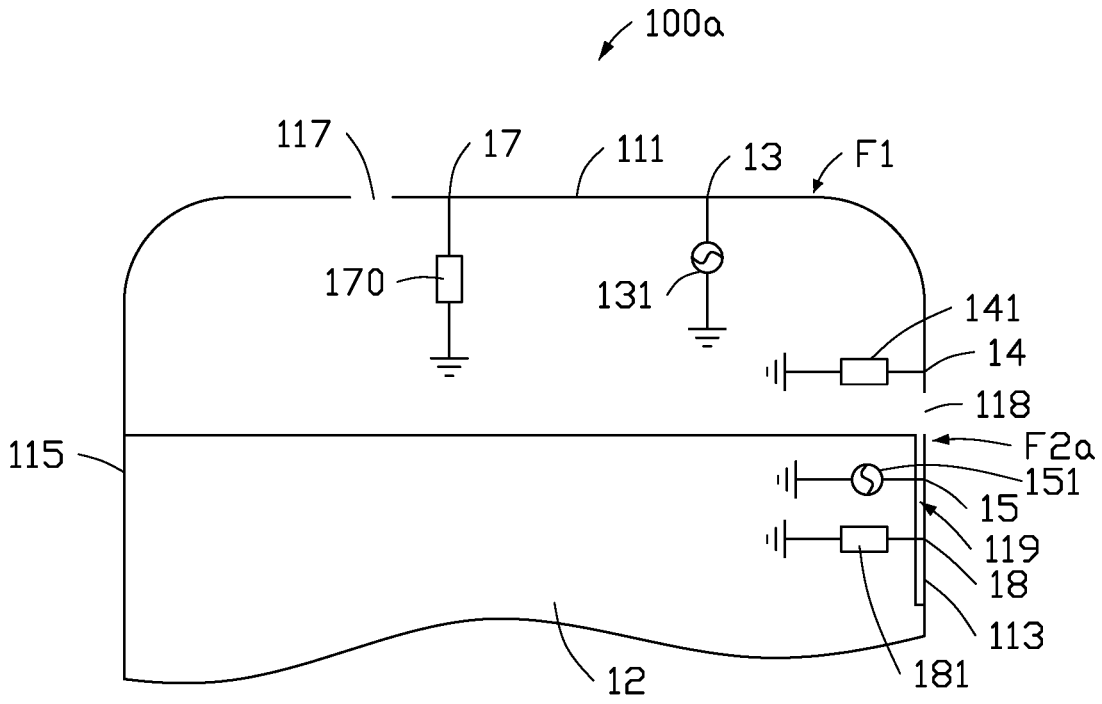
FIG. 10 is a schematic diagram of a second embodiment of an antenna structure.

FIG. 10 illustrates a second embodiment of an electronic device (electronic device 200*a*) using an antenna structure (antenna structure 100*a*). The electronic device 200*a* can be, for example, a mobile phone or a personal digital assistant. The antenna structure 100*a* can transmit and receive radio waves.

The antenna structure 100*a* at least includes a housing 11, a system ground plane 12, a first feed point 13, a first ground point 14, a second feed point 15, and a switch point 17. The housing 11 defines the first gap 117 and the second gap 118, to create the first radiation portion F1 and a second radiation portion F2*a* out of the housing 11. The system ground plane 12 defines the slit 119. The first ground point 14 is grounded through the first inductive element 141. The switching point 17 is grounded through the switch circuit 170.

Difference between the antenna structure 100*a* and the antenna structure 100 is that the antenna structure 100*a* includes a second ground point 18. In this embodiment, the second ground point 18 is positioned on the second radiation portion F2*a*. The second ground point 18 is spaced from the second feed point 15 and is further away from the second gap 118 relative to the second feed point 15. One end of the second ground point 18 can be grounded through a second inductive element 181. The first inductive element 141 and the second inductive element 181 can be arranged on either side of the second feed point 15.

In this embodiment, the working principles and specific working frequencies of the first radiation portion F1 of structure 100*a* are the same as those of the first radiation portion F1 of the structure 100, so will not be repeated here. But the working principles and specific working frequencies of the second radiation portion F2*a* of structure 100*a* are different from those of the second radiation portion F2 of the antenna structure 100.

Figure 11:
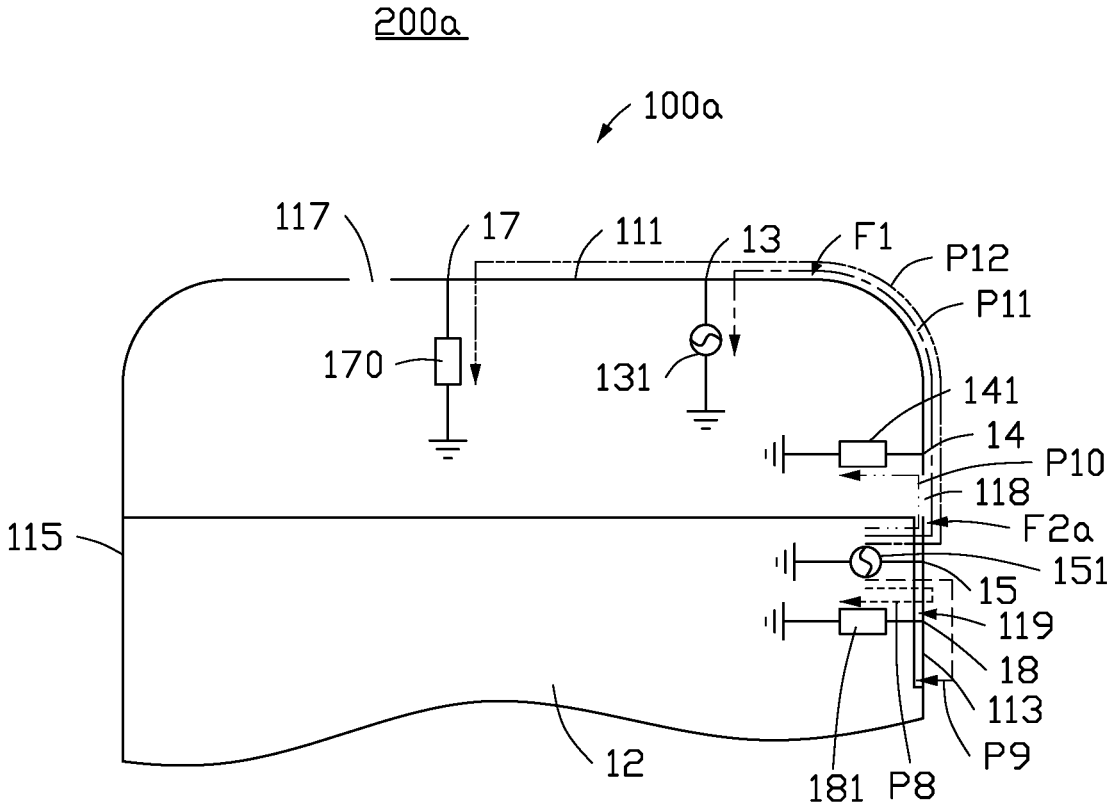
FIG. 11 is a current path distribution graph of the second radiation portion of the antenna structure of FIG. 10.

In detail, as illustrated in FIG. 11, in this embodiment, when the second feed point 15 supplies a current, the current flows through a portion of the second radiation portion F2*a* between the second feed point 15 and the second ground point 18 (hereinafter referred to as a fifth radiation section), and is grounded through the second inductive element 181 (path P8). When the second feed point 15 supplies a current, the current flows through the fifth radiation section of the second radiation portion F2 and a section between the second ground point 18 and an end of the second radiation portion F2*a* away from the second gap 118 (hereinafter referred to as a sixth radiation section, this is path P9).

Meanwhile, when the second feed point 15 supplies a current, the current flows through the fourth radiation section, then is coupled to the first inductive element 141 of the first radiation portion F1 through the second gap 118 (path P10).

When the second feed point 15 supplies a current, the current flows through the fourth radiation section, is coupled to the second radiation section of the first radiation portion F1 through the second gap 118, and flows through the first feed point 13 and the first signal point 131 (path P11). When the second feed point 15 supplies a current, the current flows through the fourth radiation section of the second radiation portion F2*a*, is coupled to the second radiation section and the first radiation section of the first radiation portion F1 through the second gap 118, and flows through the switching point 17 and the switch circuit 170 (path P12).

In this embodiment, the fifth radiation section of the second radiation portion F2*a* is a 5GNR N79 radiator, which excites a 5GNR N79 mode. The sixth radiation section of the second radiation portion F2*a* is a first middle frequency radiator, which excites a first middle frequency mode. The fourth radiation section of the second radiation portion F2*a* is coupled with the first inductive element 141 to resonate in ultra-high frequency and 5GNR N77, N78 modes. The first inductive element 141 is used to adjust or control the frequency offset of the ultra-high frequency mode, and 5G NR N77 and N78 modes. In addition, the fourth radiation section of the second radiation portion F2*a* is coupled with the second radiation section of the first radiation portion F1 to resonate in the high frequency mode. The fourth radiation section of the second radiation portion F2*a* is also coupled with the first radiation section and the second radiation section of the first radiation portion F1 to resonate in a second middle frequency mode.

Figure 12:
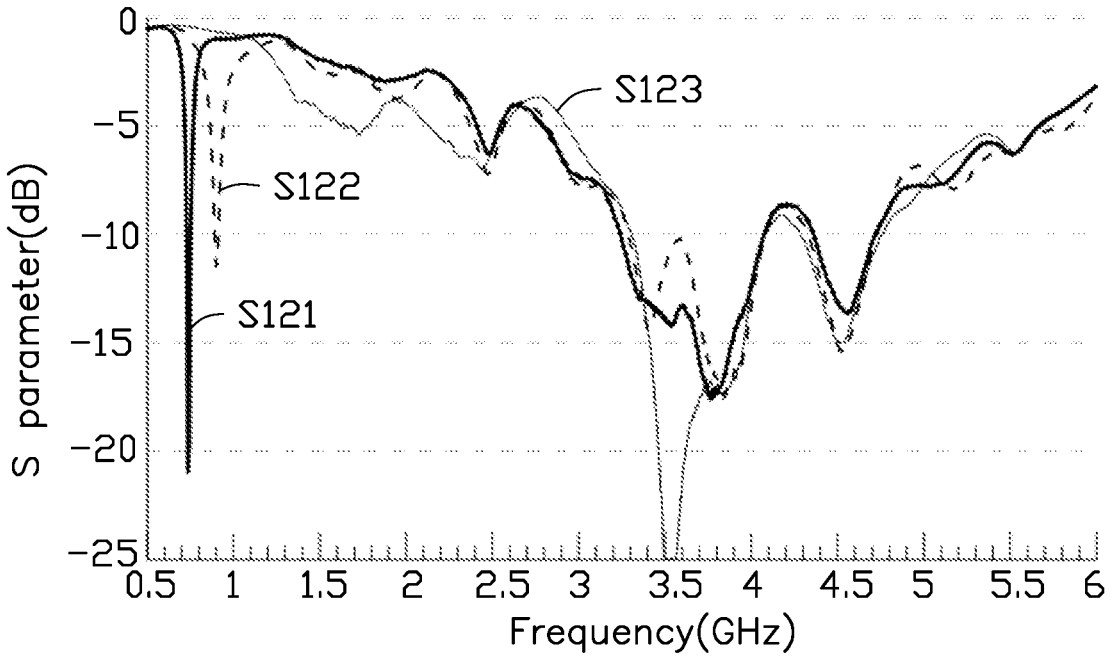
FIG. 12 is a scattering parameter graph of the first radiation portion of the antenna structure of FIG. 10.

FIG. 12 is a scattering parameter graph of the first radiation portion F1 of the antenna structure 100*a*. A curve S121 is an S11 value of the antenna structure 100*a*, when the first radiation portion F1 works in a frequency band of LB 700, a middle frequency band, a high frequency band, an ultra-high frequency band (UHB), and 5G sub6 NR N77/N78/N79 frequency bands. A curve S122 is an S11 value of the antenna structure 100*a*, when the first radiation portion F1 works in a frequency band of LB 900, a middle frequency band, a high frequency band, an ultra-high frequency band (UHB), and 5G sub6 NR N77/N78/N79 frequency bands. A curve S123 is an S11 value of the antenna structure 100*a*, when the first radiation portion F1 works in a middle frequency band, an ultra-middle frequency band (UMB), a high frequency band, an ultra-high frequency band (UHB), and 5G sub6 NR N77/N78/N79 frequency bands.

Figure 13:
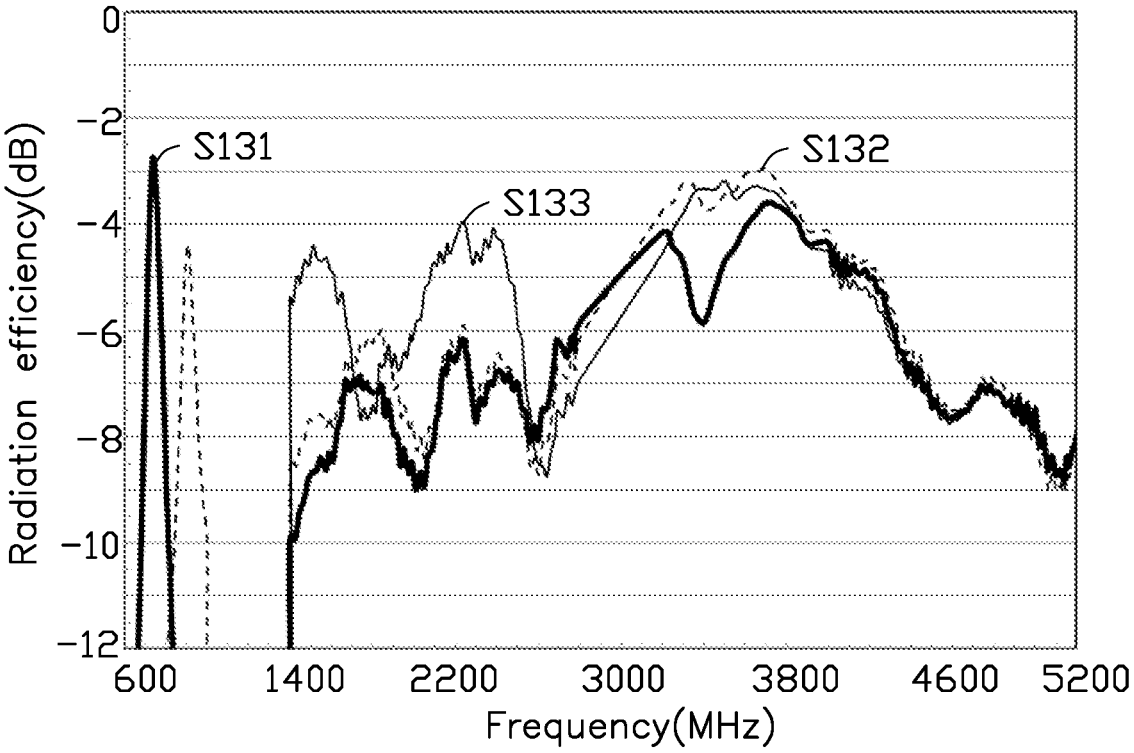
FIG. 13 is a radiation efficiency graph of the first radiation portion of the antenna structure of FIG. 10.

FIG. 13 is a radiation efficiency graph of the first radiation portion F1 of the antenna structure 100*a*. A curve S131 is a radiation efficiency of the antenna structure 100*a*, when the first radiation portion F1 works in a frequency band of LB 700, a middle frequency band, a high frequency band, an ultra-high frequency band (UHB), and 5G sub6 NR N77/N78/N79 frequency bands. A curve S132 is a radiation efficiency of the antenna structure 100*a*, when the first radiation portion F1 works in a frequency band of LB 900, a middle frequency band, a high frequency band, an ultra-high frequency band (UHB), and 5G sub6 NR N77/N78/N79 frequency bands. A curve S133 is a radiation efficiency of the antenna structure 100*a*, when the first radiation portion F1 works in a middle frequency band, an ultra-middle frequency band (UMB), a high frequency band, an ultra-high frequency band (UHB), and 5G sub6 NR N77/N78/N79 frequency bands.

Figure 14:
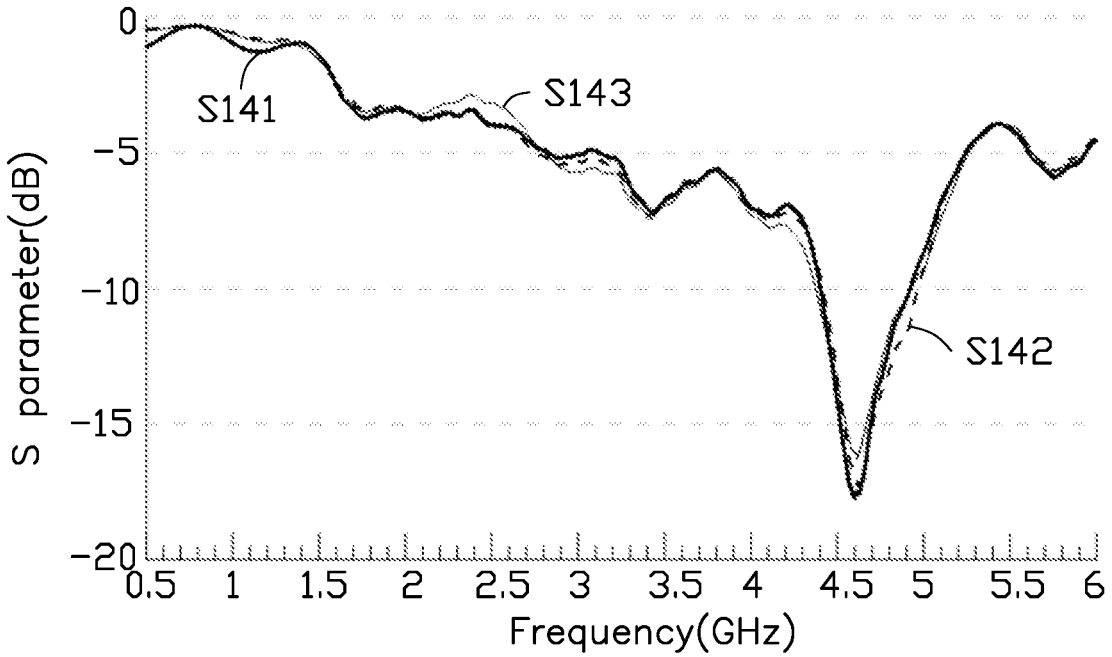
FIG. 14 is a scattering parameter graph of the second radiation portion of the antenna structure of FIG. 10.

FIG. 14 is a scattering parameter graph of the second radiation portion F2*a* of the antenna structure 100*a*. A curve S141 is an S11 value of the antenna structure 100*a*, when the first radiation portion F1 works in a frequency band of LB 700 and the second radiation portion F2*a* works in a middle frequency band, a high frequency band, an ultra-high frequency band (UHB), and 5G sub6 NR N77/N78/N79 frequency bands. A curve S142 is an S11 value of the antenna structure 100*a*, when the first radiation portion F1 works in a frequency band of LB 900 and the second radiation portion F2*a* works in a middle frequency band, a high frequency band, an ultra-high frequency band (UHB), and 5G sub6 NR N77/N78/N79 frequency bands. A curve S143 is an S11 value of the antenna structure 100*a*, when the first radiation portion F1 works in an ultra-middle frequency band and the second radiation portion F2*a* works in a middle frequency band, a high frequency band, an ultra-high frequency band (UHB), and 5G sub6 NR N77/N78/N79 frequency bands.

Figure 15:
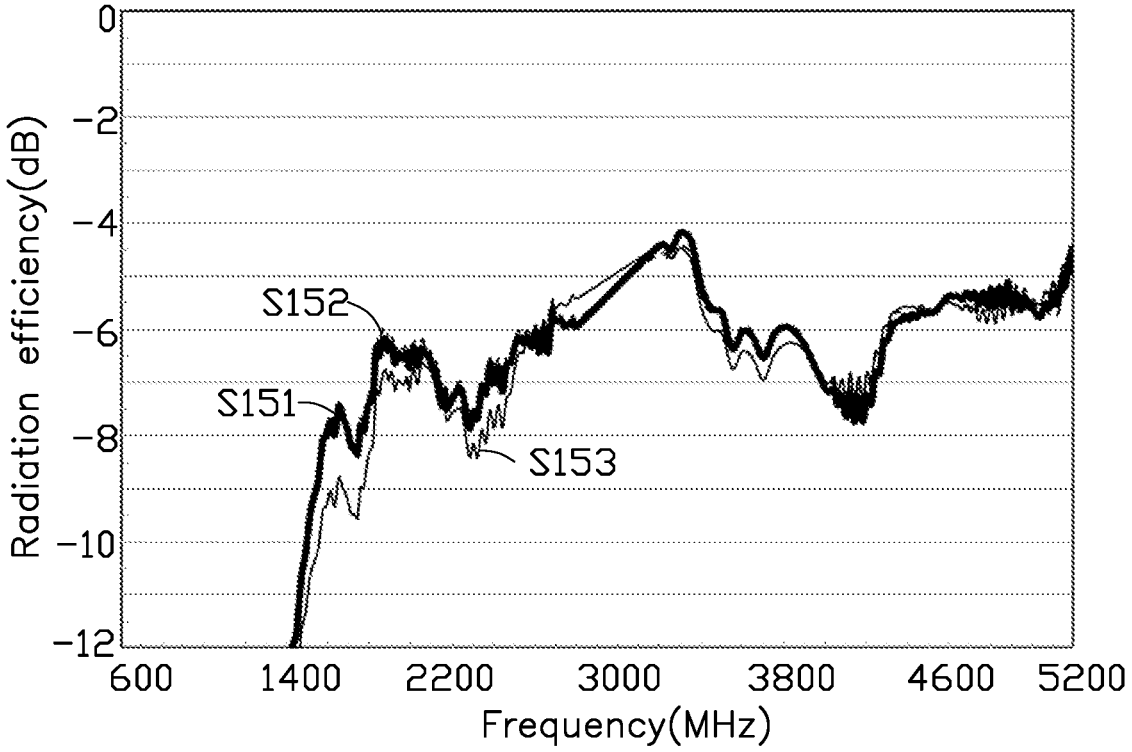
FIG. 15 is a radiation efficiency graph of the second radiation portion of the antenna structure of FIG. 10.

FIG. 15 is a radiation efficiency graph of the second radiation portion F2*a* of the antenna structure 100*a*. A curve S151 is a radiation efficiency of the antenna structure 100*a*, when the first radiation portion F1 works in a frequency band of LB 700 and the second radiation portion F2*a* works in a middle frequency band, a high frequency band, an ultra-high frequency band (UHB), and 5G sub6 NR N77/N78/N79 frequency bands. A curve S152 is a radiation efficiency of the antenna structure 100*a*, when the first radiation portion F1 works in a frequency band of LB 900 and the second radiation portion F2*a* works in a middle frequency band, a high frequency band, an ultra-high frequency band (UHB), and 5G sub6 NR N77/N78/N79 frequency bands. A curve S153 is a radiation efficiency of the antenna structure 100*a*, when the first radiation portion F1 works in an ultra-middle frequency band and the second radiation portion F2*a* works in a middle frequency band, a high frequency band, an ultra-high frequency band (UHB), and 5G sub6 NR N77/N78/N79 frequency bands.

As shown in FIG. 12 to FIG. 15, in this embodiment, the antenna structure 100*a* includes the first radiation portion F1 and the second radiation portion F2*a*. Two radiation portions, that is, the first radiation portion F1 and the second radiation portion F2*a*, can operate in tunable broadband modes by coupling and two inductive elements (for example, the first inductive element 141 and the second inductive element 181) can effectively increase the bandwidths of middle frequency, high frequency and ultra-high frequency, and have good antenna efficiency. The antenna structure 100*a* can cover global frequency applications, and can support 5G sub 6 N77/N78/N79 frequency bands. That is, the operating frequency range of the antenna structure 100*a* covers low frequency (703-960 MHz), ultra-middle frequency (1448-1511 MHz), middle frequency (1710-2170 MHz), high frequency (2300-2690 MHz), ultra-high frequency (3400-3800 MHz), and 5G sub6 NR N77/N78/N79 (3300-5000 MHz). Furthermore, the antenna structure 100*a* does not need an antenna tuner at the antenna feed end, such as the first feed point 13 and the second feed point 15, reducing a production cost of the product.

Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure applied to an electronic device, the antenna structure comprising:

a housing with at least one portion made of metal material, wherein the housing defines a first gap and a second gap, the housing between the first gap and the second gap form a first radiation portion;

a first feed point positioned on the first radiation portion and electrically connected to a first signal point, for feeding current and signal to the first radiation portion;

a first ground point positioned on the first radiation portion and spaced apart from the first feed point, the first ground point being grounded through a first inductive element;

a second radiation portion adjacent to the first radiation portion; and a second feed point positioned on the second radiation portion and electrically connected to a second signal point, for feeding current and signal to the second radiation portion; and a second ground point positioned on the second radiation portion and further away from the second gap than the second feed point, and the second ground point grounded through a second inductive element.

2. The antenna structure of claim 1, wherein when the second feed point supplies a current, the current is coupled to the first inductive element through the second gap, and is grounded to excite an ultra-high frequency mode and 5G NR N77 and N78 modes.

3. The antenna structure of claim 1, wherein when the second feed point supplies a current, the current flows through a portion of the second radiation portion between the second feed point and an end of the second radiation portion away from the second gap, to excite an 5G NR N79 mode.

4. The antenna structure of claim 1, wherein when the second feed point supplies a current, the current flows through aside of the second radiation portion adjacent to the second gap, and is coupled to the first inductive element through the second gap, to excite an ultra-high frequency, 5G NR N77, N78 modes.

5. The antenna structure of claim 1, wherein when the second feed point supplies a current, the current flows through a portion of the second radiation portion between the second feed point and the second ground point, and is grounded through the second inductive element, to excite a 5G NR N79 mode.

6. The antenna structure of claim 1, wherein the housing comprises a side frame, the first radiation portion and the second radiation portion are positioned on the side frame.

7. The antenna structure of claim 1, wherein when the first feed point supplies a current, the current flows through a portion of the first radiation portion between the first feed point and the second gap, and is grounded through the first inductive element, to excite an LTE-A high frequency and a 5G NR N79 mode.

8. The antenna structure of claim 1, further comprising a switch point, wherein the switching point is positioned on the first radiation portion and is adjacent to the first gap relative to the first feed point, the switching point and the first ground point are positioned at two sides of the first feed point, the switching point is grounded through a switch circuit.

9. The antenna structure of claim 8, wherein the switch circuit comprises a switching unit and a plurality of switching elements, the switching unit is electrically connected to the switching point, one end of each switching element is electrically connected to the switching unit, and the other end of each first switching element is grounded.

10. A electronic device, comprising:

an antenna structure comprising:

a housing with at least one portion made of metal material, wherein the housing defines a first gap and a second gap, the housing between the first gap and the second gap form a first radiation portion;

a first feed point positioned on the first radiation portion and electrically connected to a first signal point, for feeding current and signal to the first radiation portion;

a first ground point positioned on the first radiation portion and spaced apart from the first feed point, the first ground point being grounded through a first inductive element;

a second radiation portion adjacent to the first radiation portion; and a second feed point positioned on the second radiation portion and electrically connected to a second signal point, for feeding current and signal to the second radiation portion; and a second ground point positioned on the second radiation portion and further away from the second gap than the second feed point, and the second ground point grounded through a second inductive element.

11. The electronic device of claim 10, wherein when the second feed point supplies a current, the current is coupled to the first inductive element through the second gap, and is grounded to excite an ultra-high frequency mode and 5G NR N77 and N78 modes.

12. The electronic device of claim 10, wherein when the second feed point supplies a current, the current flows through a portion of the second radiation portion between the second feed point and an end of the second radiation portion away from the second gap, to excite an 5G NR N79 mode.

13. The electronic device of claim 10, wherein when the second feed point supplies a current, the current flows through the side of the second radiation portion near the second gap, and is coupled to the first inductive element through the second gap, to excite an ultra-high frequency, 5G NR N77, N78 modes.

14. The electronic device of claim 10, wherein when the second feed point supplies a current, the current flows through the portion of the second radiation portion between the second feed point and the second ground point, and is grounded through the second inductive element, to excite an 5G NR N79 mode.

15. The electronic device of claim 10, wherein the housing comprises a side frame, the first radiation portion and the second radiation portion are positioned on the side frame.

16. The electronic device of claim 10, wherein n when the first feed point supplies a current, the current flows through the portion of the first radiation portion between the first feed point and the second gap, and is grounded through the first inductive element, to excite an ultra-high frequency and a 5G NR N79 mode.

17. The electronic device of claim 10, wherein the antenna structure further comprises a switch point, wherein the switching point is located on the first radiation portion adjacent to the first gap relative to the first feed point, the switching point and the first ground point are positioned at two sides of the first feed point, the switching point is grounded through a switch circuit.

18. The electronic device of claim 17, wherein the switch circuit comprises a switching unit and a plurality of switching elements, the switching unit is electrically connected to the switching point, one end of each switching element is electrically connected to the switching unit, and the other end of each first switching element is grounded.

* * * * *